US011151919B2

(12) United States Patent
Yoon et al.

(10) Patent No.: US 11,151,919 B2
(45) Date of Patent: Oct. 19, 2021

(54) DISPLAY DEVICE PERFORMING CLOCK MODULATION AND METHOD OF OPERATING THE DISPLAY DEVICE

(71) Applicant: Samsung Display Co., Ltd., Yongin-si (KR)

(72) Inventors: Hyun-Sik Yoon, Asan-si (KR); Daeho Hwang, Cheonan-si (KR); Jeong-Hyun Kim, Seongnam-si (KR); Junpyo Lee, Asan-si (KR); Sungsoo Choi, Anyang-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 17 days.

(21) Appl. No.: 16/268,066

(22) Filed: Feb. 5, 2019

(65) Prior Publication Data

US 2019/0244556 A1 Aug. 8, 2019

(30) Foreign Application Priority Data

Feb. 6, 2018 (KR) ..... 10-2018-0014670

(51) Int. Cl.
*G09G 3/20* (2006.01)

(52) U.S. Cl.
CPC ..... *G09G 3/20* (2013.01); *G09G 3/2096* (2013.01); *G09G 2310/0213* (2013.01); *G09G 2310/06* (2013.01); *G09G 2310/067* (2013.01); *G09G 2310/08* (2013.01); *G09G 2330/06* (2013.01); *G09G 2340/0435* (2013.01)

(58) Field of Classification Search
CPC ..... G09G 3/20; G09G 3/2096; G09G 2310/0213; G09G 2310/06; G09G 2310/067; G09G 2310/08; G09G 2330/06; G09G 5/00; G09G 2340/0435; G09G 2320/02; G09G 2320/0233; G09G 2320/04; G09G 2320/0626
USPC ..... 345/204, 208, 55, 76, 87
See application file for complete search history.

(56) References Cited

U.S. PATENT DOCUMENTS

| | | | | |
|---|---|---|---|---|
| 7,558,311 | B2 | 7/2009 | Shin et al. | |
| 2006/0072648 | A1 | 4/2006 | Kim et al. | |
| 2016/0086541 | A1* | 3/2016 | Yang | G09G 3/3291 345/691 |
| 2016/0203802 | A1 | 7/2016 | Hong et al. | |
| 2019/0173454 | A1* | 6/2019 | Jun | G09G 3/3225 |

FOREIGN PATENT DOCUMENTS

| | | | |
|---|---|---|---|
| KR | 10-2009-0076603 | A | 7/2009 |
| KR | 10-1785031 | B1 | 10/2017 |

* cited by examiner

*Primary Examiner* — Jason M Mandeville
(74) *Attorney, Agent, or Firm* — Lewis Roca Rothgerber Christie LLP

(57) ABSTRACT

A method of operating a display device includes: receiving image data at an input frame frequency; generating a modulated clock signal by modulating an input clock signal according to a modulation frequency; randomly selecting an output frame frequency within a data frequency selection range, the input frame frequency being within the data frequency selection range; determining an output start timing of the image data based on the output frame frequency; initiating, at the output start timing, output of the image data in synchronization with the modulated clock signal; and displaying an image based on the outputted image data.

7 Claims, 15 Drawing Sheets

DISPLAY DEVICE PERFORMING CLOCK MODULATION AND METHOD OF OPERATING THE DISPLAY DEVICE

CROSS-REFERENCE TO RELATED APPLICATION

This application claims priority to and the benefit of Korean Patent Application No. 10-2018-0014670, filed on Feb. 6, 2018 in the Korean Intellectual Property Office (KIPO), the entire content of which is incorporated herein by reference.

BACKGROUND

1. Field

Aspects of exemplary embodiments of the present invention relate to display devices and methods of operating the display devices.

2. Description of the Related Art

Recently, to reduce electro-magnetic interference (EMI) in or caused by a display device, a frequency modulation technique has been developed that modulates a clock signal used at an interface between a timing controller and a data driver in the display device to have a modulated frequency (e.g., a predetermined modulated frequency). This frequency modulation technique may disperse power of the clock signal across a frequency domain by periodically changing the frequency of the clock signal to reduce the EMI and, thus, may be referred to as spread spectrum clock generation (SSCG).

However, because the frequency of the clock signal is periodically changed, charging rates of pixels may vary according to horizontal lines. For example, when a frame period is an integer multiple of a modulation period, a location of a horizontal line where the clock signal has a relatively high frequency and a location of a horizontal line where the clock signal has a relatively low frequency may be fixed (e.g., the same) at all frames, and a horizontal line defect in which an image has different luminance values at the different (e.g., fixed) horizontal lines may occur. Further, when the location of the horizontal line where the clock signal has the relatively high frequency and the location of the horizontal line where the clock signal has the relatively low frequency gradually move in consecutive frames, a waterfall defect in which a horizontal line having a relative high or low luminance gradually moves may occur.

SUMMARY

Some example embodiments of the present invention provide a method of operating a display device that reduces electro-magnetic interference (EMI) by modulating a clock signal while avoiding or mitigating a horizontal line defect and a waterfall defect caused by the clock modulation.

Some example embodiments provide a display device having reduced electro-magnetic interference (EMI) by modulating a clock signal while avoiding or mitigating a horizontal line defect and a waterfall defect caused by the clock modulation.

According to an example embodiment, a method of operating a display device includes: receiving image data at an input frame frequency; generating a modulated clock signal by modulating an input clock signal according to a modulation frequency; randomly selecting an output frame frequency within a data frequency selection range, the input frame frequency being within the data frequency selection range; determining an output start timing of the image data based on the output frame frequency; initiating, at the output start timing, output of the image data in synchronization with the modulated clock signal; and displaying an image based on the outputted image data.

The randomly selecting the output frame frequency may include randomly selecting a number of total vertical lines of frame data.

The randomly selecting the number of the total vertical lines of the frame data may include: randomly selecting a number of vertical lines to be added to or subtracted from a reference total vertical line number corresponding to the input frame frequency within a vertical line change range; and determining the number of the total vertical lines by adding or subtracting the randomly selected number of the vertical lines to or from the reference total vertical line number.

The determining the output start timing of the image data may include: adjusting a vertical synchronization signal based on the randomly selected number of the total vertical lines; and determining the output start timing of the image data based on the adjusted vertical synchronization signal.

The randomly selecting the output frame frequency may include randomly selecting a number of total horizontal lines of frame data.

The randomly selecting the number of the total horizontal lines of the frame data may include: randomly selecting a number of horizontal lines to be added to or subtracted from a reference total horizontal line number corresponding to the input frame frequency within a horizontal line change range; and determining the number of the total horizontal lines by adding or subtracting the randomly selected number of the horizontal lines to or from the reference total horizontal line number.

The determining the output start timing of the image data may include: adjusting a horizontal synchronization signal based on the randomly selected number of the total horizontal lines; and determining the output start timing of the image data based on the adjusted horizontal synchronization signal.

According to another example embodiment, a method of operating a display device includes: receiving image data at an input frame frequency; randomly selecting a modulation frequency within a modulation frequency selection range, a reference modulation frequency being within the modulation frequency selection range; generating a modulated clock signal by modulating an input clock signal with the randomly selected modulation frequency; determining an output start timing of the image data based on the input frame frequency; initiating, at the output start timing, output of the image data in synchronization with the modulated clock signal; and displaying an image based on the outputted image data.

The randomly selecting the modulation frequency may include: randomly selecting a frequency to be added to or subtracted from the reference modulation frequency within a modulation frequency change range; and determining the modulation frequency by adding or subtracting the randomly selected frequency to or from the reference modulation frequency.

According to another example embodiment, a display device includes: a display panel including a plurality of pixels; a gate driver configured to provide gate signals to the plurality of pixels; a data driver configured to provide data signals to the plurality of pixels; and a timing controller configured to receive image data at an input frame frequency and to control the gate driver and the data driver The timing controller includes: a clock modulation block configured to generate a modulated clock signal by modulating an input clock signal according to a modulation frequency; and a frequency randomizer configured to randomly select an output frame frequency or the modulation frequency and to adjust an output timing of the image data based on the randomly selected output frame frequency or the modulated clock signal modulated according to the randomly selected modulation frequency.

The frequency randomizer may be configured to randomly select the output frame frequency within a data frequency selection range, the input frame frequency being within the data frequency selection range, and to determine an output start timing of the image data based on the randomly selected output frame frequency.

The frequency randomizer may include a total vertical line randomizer configured to randomly select a number of total vertical lines of frame data to randomly select the output frame frequency.

The total vertical line randomizer may be configured to receive a signal representing a vertical line change range, to randomly select a number of vertical lines to be added to or subtracted from a reference total vertical line number corresponding to the input frame frequency within the vertical line change range, to determine the number of the total vertical lines by adding or subtracting the randomly selected number of the vertical lines to or from the reference total vertical line number, and to adjust a vertical synchronization signal based on the randomly selected number of the total vertical lines.

The frequency randomizer may further include a synchronization circuit configured to determine the output start timing of the image data based on the adjusted vertical synchronization signal.

The frequency randomizer may further include a line buffer configured to temporarily store the image data in a unit of an active horizontal line.

The frequency randomizer may include a total horizontal line randomizer configured to randomly select a number of total horizontal lines of frame data to randomly select the output frame frequency.

The total horizontal line randomizer may be configured to receive a signal representing a horizontal line change range, to randomly select a number of horizontal lines to be added to or subtracted from a reference total horizontal line number corresponding to the input frame frequency within the horizontal line change range, to determine the number of the total horizontal lines by adding or subtracting the randomly selected number of the horizontal lines to or from the reference total horizontal line number, and to adjust a horizontal synchronization signal based on the randomly selected number of the total horizontal lines.

The frequency randomizer may further include a synchronization circuit configured to determine the output start timing of the image data based on the adjusted horizontal synchronization signal.

The frequency randomizer may include a modulation frequency randomizer configured to randomly select the modulation frequency within a modulation frequency selection range. A reference modulation frequency may be within the modulation frequency selection range.

The frequency randomizer may include: a total vertical line randomizer configured to randomly select a number of total vertical lines of frame data; a total horizontal line randomizer configured to randomly select a number of total horizontal lines of frame data; and a modulation frequency randomizer configured to randomly select the modulation frequency within a modulation frequency selection range. A reference modulation frequency may be within the modulation frequency selection range.

As described above, the method of operating the display device and the display device according to example embodiments of the present invention may randomly select an output frame frequency and/or a modulation frequency in each frame even when image data is received at a fixed input frame frequency and may adjust output timing of the image data based on the randomly selected output frame frequency and/or the randomly selected modulation frequency, thereby preventing or mitigating the horizontal line defect and/or the waterfall defect caused by clock modulation employed to reduce EMI.

BRIEF DESCRIPTION OF THE DRAWINGS

Illustrative, non-limiting, example embodiments will be more clearly understood from the following detailed description in conjunction with the accompanying drawings.

DETAILED DESCRIPTION

Figure 1:
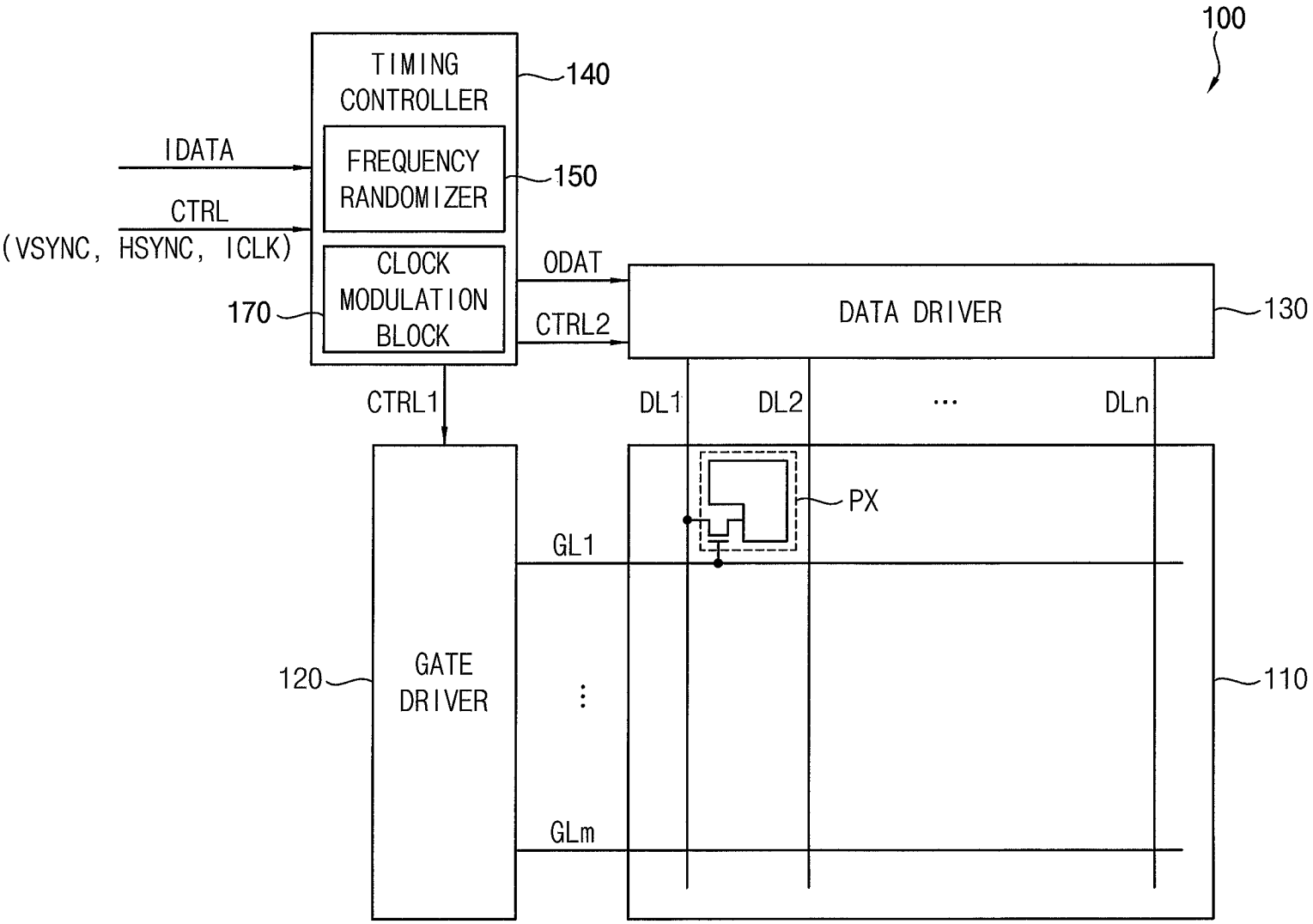
FIG. 1 is a block diagram illustrating a display device according to example embodiments.

It will be understood that when an element or layer is referred to as being "on," "connected to," or "coupled to" another element or layer, it may be directly on, connected, or coupled to the other element or layer or one or more intervening elements or layers may also be present. When an element or layer is referred to as being "directly on," "directly connected to," or "directly coupled to" another element or layer, there are no intervening elements or layers present. For example, when a first element is described as being "coupled" or "connected" to a second element, the first element may be directly coupled or connected to the second element or the first element may be indirectly coupled or connected to the second element via one or more intervening elements.

The same reference numerals designate the same elements. As used herein, the term "and/or" includes any and all combinations of one or more of the associated listed items. Further, the use of "may" when describing embodiments of the present invention relates to "one or more embodiments of the present invention." Expressions, such as "at least one of," when preceding a list of elements, modify the entire list of elements and do not modify the individual elements of the list. Also, the term "exemplary" is intended to refer to an example or illustration. As used herein, the terms "use," "using," and "used" may be considered synonymous with the terms "utilize," "utilizing," and "utilized," respectively. As used herein, the term "substantially," "about," and similar terms are used as terms of approximation and not as terms of degree, and are intended to account for the inherent variations in measured or calculated values that would be recognized by those of ordinary skill in the art.

It will be understood that, although the terms first, second, third, etc. may be used herein to describe various elements, components, regions, layers, and/or sections, these elements, components, regions, layers, and/or sections should not be limited by these terms. These terms are used to distinguish one element, component, region, layer, or section from another element, component, region, layer, or section. Thus, a first element, component, region, layer, or section discussed below could be termed a second element, component, region, layer, or section without departing from the teachings of example embodiments. In the figures, dimensions of the various elements, layers, etc. may be exaggerated for clarity of illustration.

The terminology used herein is for the purpose of describing particular example embodiments of the present invention and is not intended to be limiting of the described example embodiments of the present invention. As used herein, the singular forms "a" and "an" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components but do not preclude the presence or addition of one or more other features, integers, steps, operations, elements, components, and/or groups thereof.

Also, any numerical range disclosed and/or recited herein is intended to include all sub-ranges of the same numerical precision subsumed within the recited range. For example, a range of "1.0 to 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein, and any minimum numerical limitation recited in this specification is intended to include all higher numerical limitations subsumed therein. Accordingly, Applicant reserves the right to amend this specification, including the claims, to expressly recite any sub-range subsumed within the ranges expressly recited herein. All such ranges are intended to be inherently described in this specification such that amending to expressly recite any such subranges would comply with the requirements of 35 U.S.C. § 112(a) and 35 U.S.C. § 132(a).

The gate driver, data driver, timing controller, and/or any other relevant devices or components, such as an element referred to as a randomizer or a block, according to embodiments of the present invention described herein may be implemented utilizing any suitable hardware, firmware (e.g., an application-specific integrated circuit), software, and/or a suitable combination of software, firmware, and hardware. For example, the various components of the gate driver, data driver, and/or timing controller may be formed on one integrated circuit (IC) chip or on separate IC chips. Further, the various components of the gate driver, data driver, and/or timing controller may be implemented on a flexible printed circuit film, a tape carrier package (TCP), a printed circuit board (PCB), or formed on a same substrate as the gate driver, data driver, and/or timing controller. Further, the various components of the gate driver, data driver, and/or timing controller may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device or the functionality of a particular computing device may be distributed across one or more other computing devices without departing from the scope of the exemplary embodiments of the present invention.

Hereinafter, example embodiments of the present invention will be explained in more detail with reference to the accompanying drawings.

FIG. 1 is a block diagram illustrating a display device according to example embodiments.

Referring to FIG. 1, a display device 100 includes a display panel 110, which includes a plurality of pixels PX, a gate driver 120 for providing gate signals to the plurality of pixels PX, a data driver 130 for providing data signals to the plurality of pixels PX, and a timing controller 140 for controlling the gate driver 120 and the data driver 130.

The display panel 110 may include a plurality of gate lines GL1 to GLm, a plurality of data lines DL1, DL2, . . . DLn, and the plurality of pixels PX coupled to the plurality of gate lines GL1 to GLm and the plurality of data lines DL1, DL2, . . . DLn. In some example embodiments, the display panel 110 may be a liquid crystal display (LCD) panel, as is illustrated in FIG. 1, and in such an embodiment, each pixel PX may include a switching transistor and a liquid crystal capacitor coupled to the switching transistor. In other example embodiments, the display panel 110 may be an OLED display panel, and in such an embodiments, each pixel PX may include a plurality of transistors, one or more capacitors, and an organic light emitting diode (OLED). However, the display panel 110 is not limited to the LCD panel and the OLED display panel and may be any suitable display panel.

The gate driver 120 may generate the gate signals based on a gate control signal CTRL1 output from the timing controller 140 and may sequentially apply the gate signals to the plurality of gate lines GL1 to GLm. In some example embodiments, the gate control signal CTRL1 may include, but is not limited to, a gate clock signal CPV and a scan start pulse STV. According to example embodiments, the gate driver 120 may be mounted directly on the display panel 110, coupled to the display panel 110 in a form of a tape carrier package (TCP), or may be integrated in a peripheral portion of the display panel 110.

The data driver 130 may generate analog data signals based on image data ODAT and a data control signal CTRL2 output from the timing controller 140 and may apply the data signals to the plurality of data lines DL1, DL2, . . . DLn. In some example embodiments, the data control signal CTRL2 may include, but is not limited to, a horizontal start signal and a load signal. According to example embodiments, the data driver 130 may be mounted directly on the display panel 110, coupled to the display panel 110 in a form of a TCP, or may be integrated in the peripheral portion of the display panel 110.

The timing controller 140 may receive image data IDAT and a control signal CTRL from an external host (e.g., a graphic processing unit (GPU)). The image data IDAT may include (or may be transferred at or transmitted with) a fixed input frame frequency (or a fixed input frame rate) and, in some example embodiments, may include red image data, green image data, and blue image data. In some example embodiments, the control signal CTRL may include a vertical synchronization signal VSYNC, a horizontal synchronization signal HSYNC, and an input clock signal ICLK. The timing controller 140 may generate the gate control signal CTRL1, the data control signal CTRL2, and the image data ODAT based on the control signal CTRL and the image data IDAT. The timing controller 140 may control an operation of the gate driver 120 by providing the gate control signal CTRL1 to the gate driver 120 and may control an operation of the data driver 130 by providing the data control signal CTRL2 to the data driver 130.

The timing controller 140 may include a clock modulation block 170, which generates a modulated clock signal by periodically modulating the input clock signal ICLK provided from the external host (or by periodically modulating an internal clock signal generated by the timing controller 140) according to a modulation frequency. In some example embodiments, the clock modulation block 170 may be a spread spectrum clock generator that disperses power of the modulated clock signal across a frequency domain by changing (or modulating) (e.g., by continuously changing or modulating) a frequency of the input clock signal ICLK. The timing controller 140 may transfer the image data ODAT to the data driver in synchronization with the modulated clock signal that is periodically modulated according to the modulation frequency. Accordingly, because the power of the image data ODAT transferred between the timing controller 140 and the data driver 130 is dispersed across the frequency domain, electro-magnetic interference (EMI) in (or caused by) the display device 100 may be reduced.

The timing controller 140 may further include a frequency randomizer 150 that randomly selects an output frame frequency or the modulation frequency in each (e.g., every) frame and adjusts an output timing of the image data based on the randomly selected output frame frequency or the modulated clock signal modulated according to the randomly selected modulation frequency.

In some example embodiments, the timing controller may receive the image data IDAT at the fixed input frame frequency (e.g., after the input frame frequency is set, the input frame frequency is fixed or constant until the input frame frequency is reset) but may control the display device 100 based on the output frame frequency that is randomly selected by the frequency randomizer 150. For example, the frequency randomizer 150 may randomly select the output frame frequency within a data frequency selection range including the input frame frequency in each (e.g., every) frame and may determine an output start timing of the image data ODAT based on the randomly selected output frame frequency.

In other example embodiments, the frequency randomizer 150 may randomly select the modulation frequency within a modulation frequency selection range, which includes a reference modulation frequency, in each (e.g., every) frame. In such an embodiment, the timing controller 140 may output the image data ODAT in synchronization with the modulated clock signal that is modulated according to the randomly selected modulation frequency.

In a display device according to the related art that uses spread spectrum clock generation (SSCG), which disperses power of a clock signal across a frequency domain by periodically changing a frequency of the clock signal used at an interface between a timing controller and a data driver to reduce the EMI, charging rates of pixels may vary in different horizontal lines of the display device according to the related art because the frequency of the clock signal is periodically changed. For example, when a frame period is an integer multiple of a modulation period, a location of a horizontal line where the clock signal has a relatively high frequency and a location of a horizontal line where the clock signal has a relatively low frequency may be fixed at all frames, and a horizontal line defect, in which an image has different luminance values at the fixed horizontal lines, may occur. Further, when the location of the horizontal line where the clock signal has the relatively high frequency and the location of the horizontal line where the clock signal has the relatively low frequency gradually moves in consecutive frames, a waterfall defect, in which a horizontal line having a relative high or low luminance gradually moves, may occur.

In the display device 100 according to example embodiments, the EMI caused by the display device 100 may be reduced by outputting the image data ODAT in synchronization with the modulated clock signal that is modulated according to the modulation frequency. As such, the location of the horizontal line where the image is displayed with relatively high luminance and the location of the horizontal line where the image is displayed with relatively low luminance may be randomly changed in each (e.g., every) frame by randomly changing the output frame frequency and/or the modulation frequency in each (e.g., every) frame by using the frequency randomizer 150, thereby preventing or mitigating the horizontal line defect and/or the waterfall defect.

Figure 2:
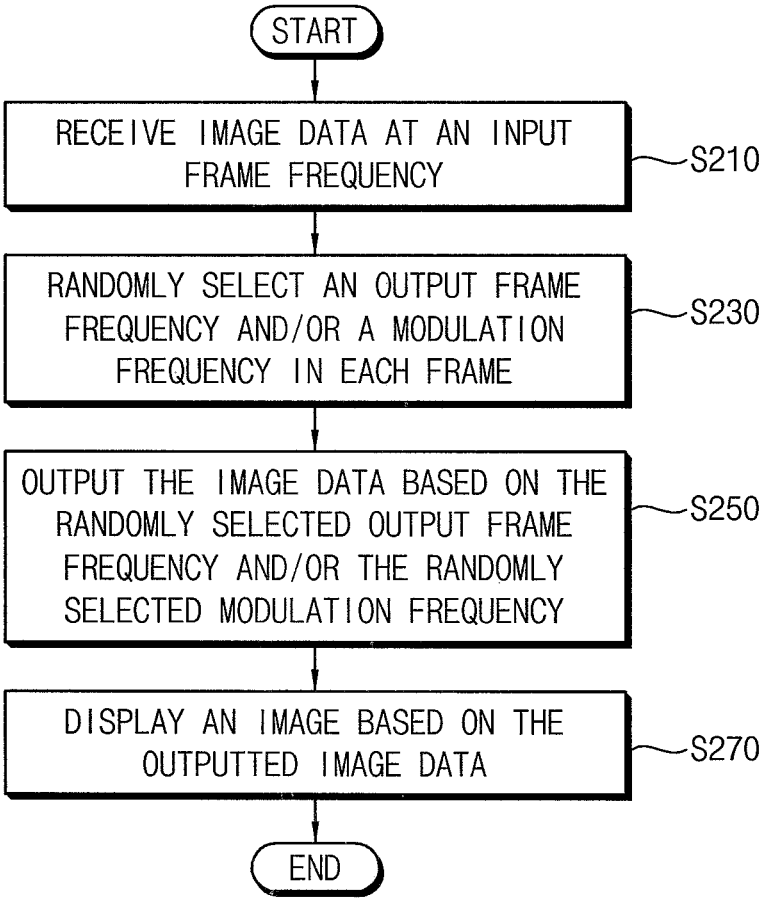
FIG. 2 is a flowchart illustrating a method of operating a display device according to example embodiments.

FIG. 2 is a flowchart illustrating a method of operating a display device according to example embodiments.

Referring to FIGS. 1 and 2, in a method of operating the display device 100 according to example embodiments, the timing controller 140 may receive image data IDAT at an input frame frequency (S210).

The timing controller 140 may randomly select an output frame frequency and/or a modulation frequency (S230) and may output the image data ODAT based on the randomly selected output frame frequency and/or the randomly selected modulation frequency (S250). The display device 100 may display an image based on the outputted image data ODAT (S270).

In some example embodiments, the frequency randomizer 150 may randomly select the output frame frequency within a data frequency selection range, which includes the input frame frequency, in each frame and may determine an output start timing of the image data ODAT based on the randomly selected output frame frequency. Accordingly, although the modulation frequency of a modulated clock signal is fixed or constant in each frame, a length of each frame period in which an image is displayed may change according to the output frame frequency, and thus, a location of a horizontal line where the image is displayed with relatively high luminance and a location of a horizontal line where the image is displayed with relatively low luminance may be randomly changed in each frame, thereby preventing or mitigating the horizontal line defect and/or the waterfall defect.

In other example embodiments, the frequency randomizer 150 may randomly select the modulation frequency within a modulation frequency selection range including a reference modulation frequency in each frame. The timing controller 140 may output the image data ODAT in synchronization with the modulated clock signal that is modulated according to the randomly selected modulation frequency. Accordingly, although the length of each frame period is fixed or constant, the modulation frequency of the modulated clock signal may be randomly changed in each frame, and thus, the location of the horizontal line where the image is displayed with relatively high luminance and the location of the horizontal line where the image is displayed with relatively low luminance may be randomly changed in each frame, thereby preventing or mitigating the horizontal line defect and/or the waterfall defect.

Figure 3:
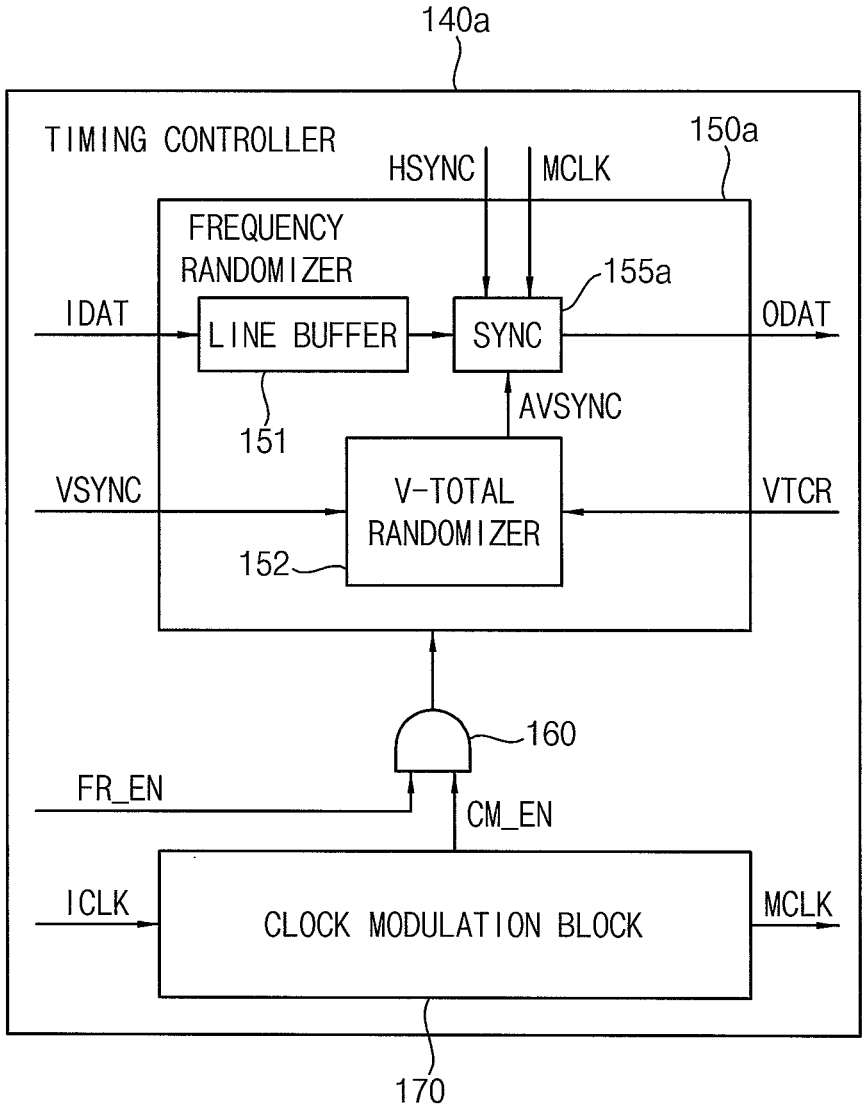
FIG. 3 is a block diagram illustrating a timing controller according to example embodiments.

FIG. 3 is a block diagram illustrating a timing controller according to example embodiments.

Referring to FIG. 3, a timing controller 140*a* may include a frequency randomizer 150*a*, which randomly selects an output frame frequency in each frame, and a clock modulation block 170, which generates a modulated clock signal MCLK by periodically modulating an input clock signal ICLK according to a modulation frequency. In some example embodiments, the timing controller 140*a* may further include an AND gate 160 that enables the frequency randomizer 150*a* by performing an AND operation on a clock modulation enable signal CM_EN representing that clock modulation is to be performed and a frequency randomization enable signal FR_EN that indicates whether or not frequency randomization is performed.

The frequency randomizer 150*a* may include a line buffer 151, which temporarily stores image data IDAT in a unit of a horizontal line (or an active horizontal line), a total vertical line randomizer 152, which randomly selects the number of total vertical lines of frame data in each frame to randomly select the output frame frequency, and a synchronization circuit 155*a*, which initiates outputting the image data ODAT stored in the line buffer 151 in response to an adjusted vertical synchronization signal AVSYNC and a horizontal synchronization signal HSYNC and outputs the image data ODAT in synchronization with the modulated clock signal MCLK.

The line buffer 151 may have a size (e.g., a memory size) sufficient to store the image data DAT of a number of horizontal lines corresponding to double a vertical line change range VTCR of the total vertical line randomizer 152.

The total vertical line randomizer 152 may receive a signal representing the vertical line change range VTCR and may randomly select the number of vertical lines to be added to or subtracted from a reference total vertical line number corresponding to the input frame frequency within the vertical line change range VTCR. Further, the total vertical line randomizer 152 may determine the number of the total vertical lines by adding or subtracting the randomly selected number of the vertical lines to or from the reference total vertical line number and may generate the adjusted vertical synchronization signal AVSYNC by adjusting a vertical synchronization signal VSYNC based on the randomly selected number of the total vertical lines.

The synchronization circuit 155*a* may determine an output start timing of the image data ODAT based on the adjusted vertical synchronization signal AVSYNC. Further, the synchronization circuit 155*a* may initiate outputting the image data ODAT at the determined output start timing and may output the image data ODAT in synchronization with the modulated clock signal MCLK.

Hereinafter, a method of operating the display device including the timing controller 140*a* according to example embodiments will be described with reference to FIGS. 3-6.

Figure 4:
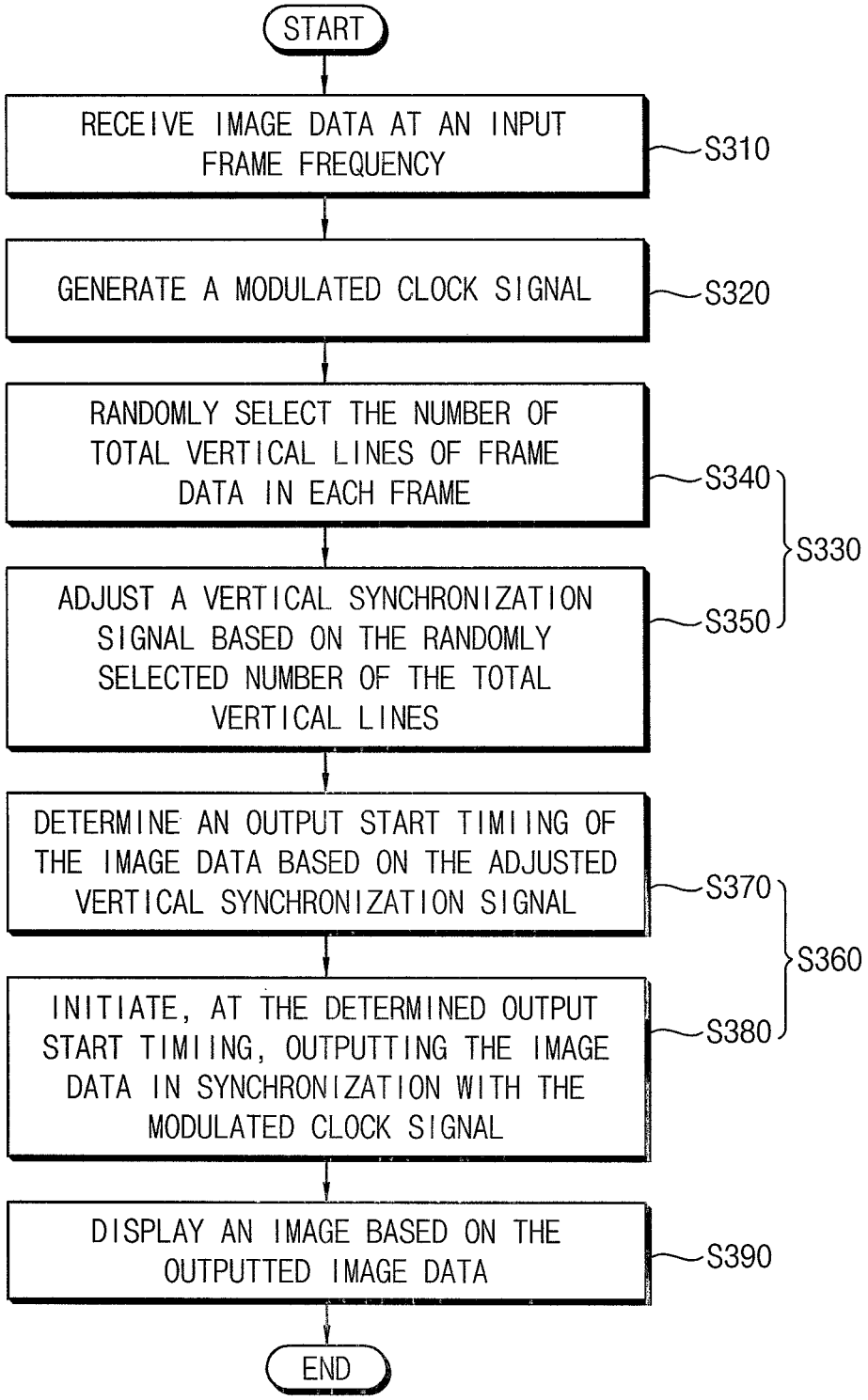
FIG. 4 is a flowchart illustrating a method of operating a display device according to example embodiments.
Figure 5:
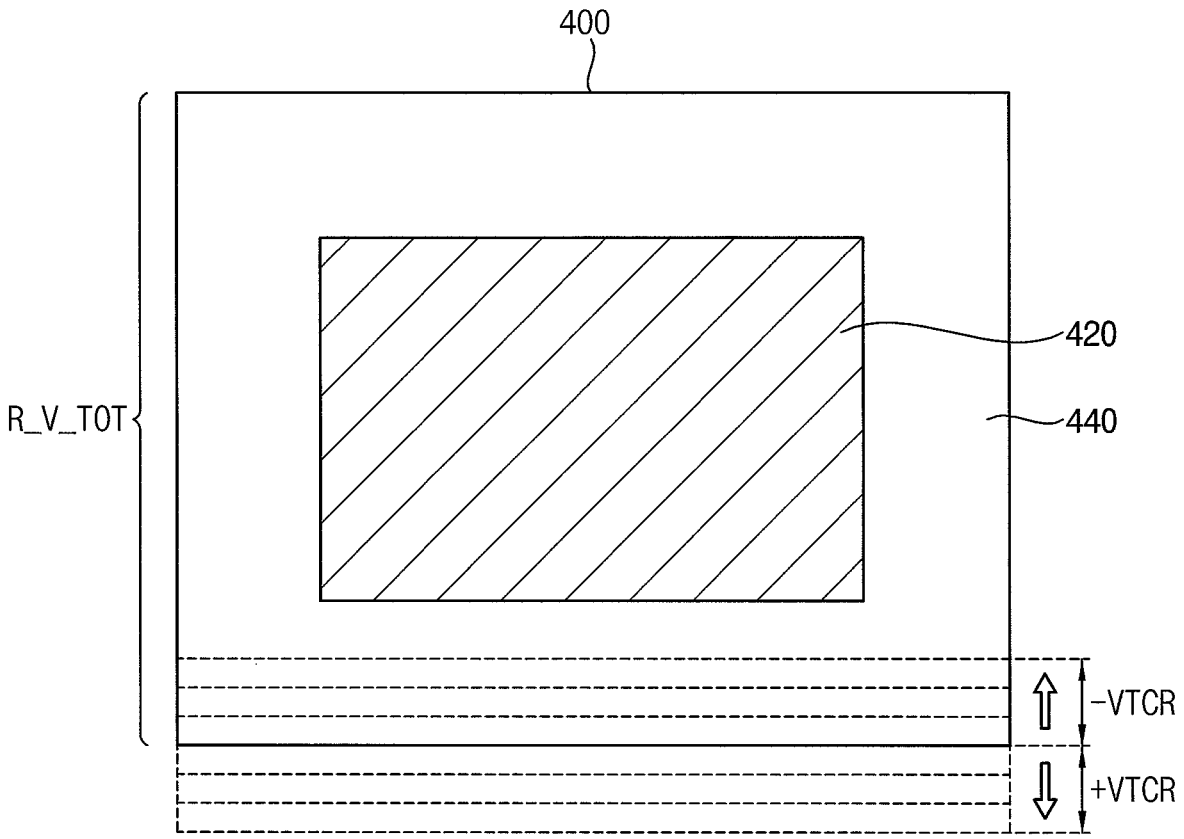
FIG. 5 is a diagram describing an example where the number of total vertical lines of frame data is randomly changed.
Figure 6:
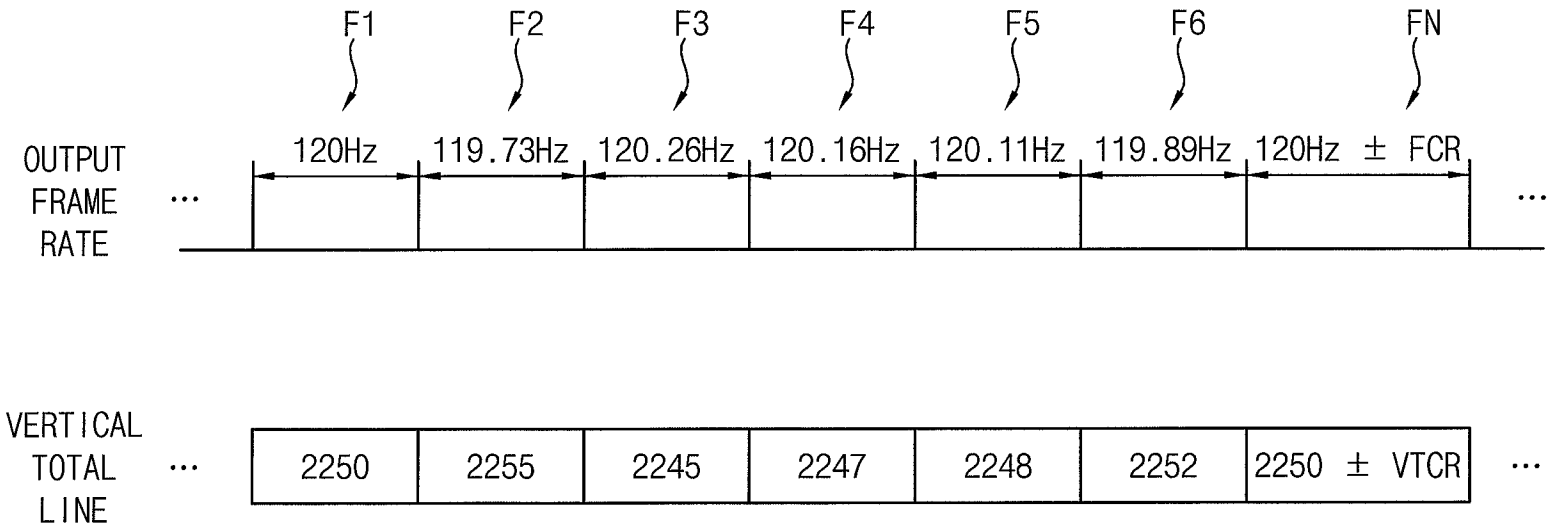
FIG. 6 is a diagram describing an example where an output frame frequency is changed in each frame depending on a change of the number of total vertical lines.

FIG. 4 is a flowchart illustrating a method of operating a display device according to example embodiments, FIG. 5 is a diagram describing an example in which the number of total vertical lines of frame data is randomly changed, and FIG. 6 is a diagram describing an example in which an output frame frequency is changed in each frame depending on a change of the number of total vertical lines.

Referring to FIGS. 3 and 4, the timing controller 140*a* may receive image data IDAT at an input frame frequency (e.g., a predetermined input frame frequency) (S310). Further, the timing controller 140*a* may receive an input clock signal ICLK, and a clock modulation block 170 of the timing controller 140*a* may generate a modulated clock signal MCLK by modulating the input clock signal ICLK according to a modulation frequency (e.g., a predetermined modulation frequency) (S320).

The frequency randomizer 150*a* of the timing controller 140*a* may randomly select an output frame frequency within a data frequency selection range, which includes the input frame frequency, in each frame (S330). In some example embodiments, to randomly select the output frame frequency, the total vertical line randomizer 152 of the frequency randomizer 150*a* may randomly select the number of total vertical lines of frame data in each frame (S340) and may generate an adjusted vertical synchronization signal AVSYNC by adjusting a timing of a vertical synchronization signal VSYNC to correspond to the randomly selected number of the total vertical lines (S350).

For example, referring to FIG. 5, the image data IDAT for one frame may correspond to frame data 400 including active data 420 and blank data 440. Further, the image data IDAT received at the input frame frequency during one frame period, or the frame data 400, may have a reference total vertical line number R_V_TOT corresponding to the input frame frequency. Although the timing controller 140*a* receives the frame data 400 having the fixed reference total vertical line number R_V_TOT, the timing controller 140*a* may output the image data ODAT at the output frame frequency corresponding to the randomly selected number of total vertical lines in each frame. For example, the total vertical line randomizer 152 of the frequency randomizer 150*a* may randomly select the number of vertical lines to be added to or subtracted from the reference total vertical line number R_V_TOT corresponding to the input frame frequency within a vertical line change range VTCR and may determine the number of the total vertical lines by adding or subtracting the randomly selected number of the vertical lines to or from the reference total vertical line number R_V_TOT. Accordingly, a length of a frame period for one frame may be randomly adjusted and the output frame frequency may be randomly determined.

The timing controller 140*a* may output the image data ODAT at the randomly selected output frame frequency (S360). In some example embodiments, the synchronization circuit 155*a* of the timing controller 140*a* may determine an output start timing of the image data ODAT based on the adjusted vertical synchronization signal AVSYNC that is adjusted corresponding to the randomly selected output frame frequency or the randomly selected number of the total vertical lines (S370). The synchronization circuit 155*a* may initiate outputting the image data ODAT at the output start timing and may output the image data ODAT in synchronization with the modulated clock signal MCLK (S380).

For example, as illustrated in FIG. 6, when the input frame frequency is 120 Hz and the reference total vertical line number R_V_TOT corresponding to the input frame frequency is 2250, the total vertical line randomizer 152 may randomly select the number of the total vertical lines in a range between the reference total vertical line number R_V_TOT plus the vertical line change range VTCR and the reference total vertical line number R_V_TOT minus the vertical line change range VTCR. The synchronization circuit 155*a* may output the image data ODAT at an output frame frequency corresponding to the randomly selected number of the total vertical lines or an output frame frequency that is randomly selected in a range between the input frame frequency plus a frame change range FCR corresponding to the vertical line change range VTCR and the input frame frequency minus the frame change range FCR. In the example shown in FIG. 6, in a first frame F1, when the total vertical line randomizer 152 selects 2250 as the number of the total vertical lines, that is the same as the reference total vertical line number R_V_TOT, the synchronization circuit 155*a* may output the image data ODAT at an output frame frequency of 120 Hz, which is the same as the input frame frequency. In second and sixth frames F2 and F6, when the total vertical line randomizer 152 selects 2255 and 2252 as the number of the total vertical lines, respectively, both of which are greater than the reference total vertical line number R_V_TOT, a length of a frame period of each of the second and sixth frames F2 and F6 may increase, and the synchronization circuit 155*a* may output the image data ODAT at about 119.73 Hz and about 119.89 Hz, both of which are less than the input frame frequency. Further, in third through fifth frames F3, F4, and F5, when the total vertical line randomizer 152 selects 2245, 2247, and 2248 as the number of the total vertical lines, respectively, each of which are less than the reference total vertical line number R_V_TOT, a length of a frame period of each of the third through fifth frames F3, F4, and F5 may be decreased, and the synchronization circuit 155*a* may output the image data ODAT at about 120.26 Hz, about 120.16 Hz, and about 120.11 Hz, each of which are increased from the input frame frequency. Thus, in a frame FN, the total vertical line randomizer 152 may select the number of the total vertical lines in a range between the reference total vertical line number R_V_TOT plus the vertical line change range VTCR and the reference total vertical line number R_V_TOT minus the vertical line change range VTCR, and the synchronization circuit 155*a* may output the image data ODAT at an output frame frequency in a range between the input frame frequency plus the frame change range FCR and the input frame frequency minus the frame change range FCR.

A display device may display an image based on the image data ODAT outputted at the output frame frequency (S390). Accordingly, even when the modulation frequency of the modulated clock signal is fixed or constant in each frame, a length of each frame period in which an image is displayed may be varied according to the randomly selected output frame frequency or according to the randomly selected number of the total vertical lines, and thus, a location of a horizontal line where the image is displayed with relatively high luminance and a location of a horizontal line where the image is displayed with relatively low luminance may be randomly changed in each frame, thereby preventing or mitigating a horizontal line defect and/or a waterfall defect.

Figure 7:
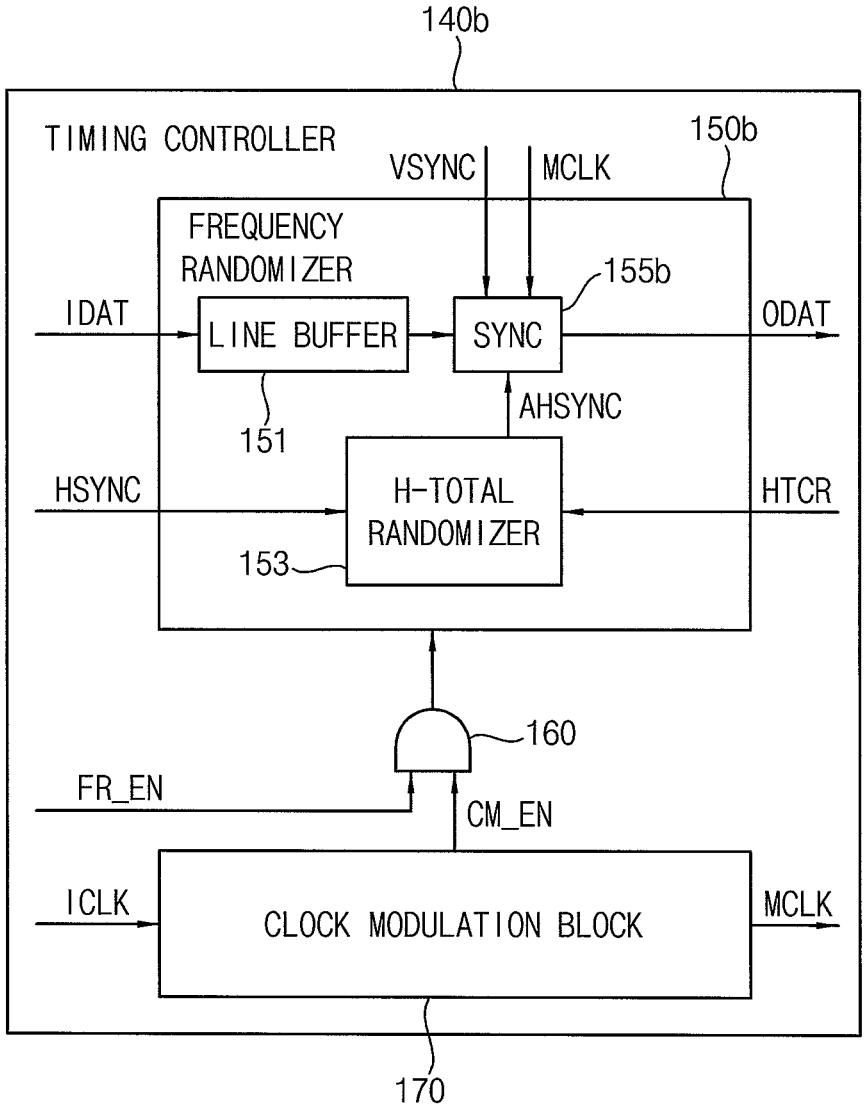
FIG. 7 is a block diagram illustrating a timing controller according to example embodiments.

FIG. 7 is a block diagram illustrating a timing controller according to an example embodiment.

The timing controller 140*b* shown in FIG. 7 may have a similar configuration and may operate similarly to the timing controller 140*a* shown in FIG. 3, except that the timing controller 140*b* may include a total horizontal line randomizer 153.

Referring to FIG. 7, the timing controller 140*b* may include a frequency randomizer 150*b*, a clock modulation block 170, and an AND gate 160. The frequency randomizer 150*b* may include a line buffer 151, the total horizontal line randomizer 153, which randomly selects the number of total horizontal lines of frame data in each frame to randomly select an output frame frequency, and a synchronization circuit 155*b*, which initiates outputting image data ODAT in response to a vertical synchronization signal VSYNC and an adjusted horizontal synchronization signal AHSYNC and outputs the image data ODAT in synchronization with a modulated clock signal MCLK.

The total horizontal line randomizer 153 may receive a signal representing a horizontal line change range HTCR and may randomly select the number of horizontal lines to be added to or subtracted from a reference total horizontal line number corresponding to the input frame frequency within the horizontal line change range HTCR. The total horizontal line randomizer 153 may determine the number of the total horizontal lines by adding or subtracting the randomly selected number of the horizontal lines to or from the reference total horizontal line number and may generate the adjusted horizontal synchronization signal AHSYNC by adjusting a horizontal synchronization signal HSYNC based on the randomly selected number of the total horizontal lines.

The synchronization circuit 155*b* may adjust an output start timing of the image data ODAT based on the adjusted horizontal synchronization signal AHSYNC. Further, the synchronization circuit 155*b* may initiate outputting the image data ODAT at the determined output start timing and may output the image data ODAT in synchronization with the modulated clock signal MCLK.

Hereinafter, a method of operating a display device including the timing controller 140*b* according to example embodiments will be described below with reference to FIGS. 7-10.

Figure 8:
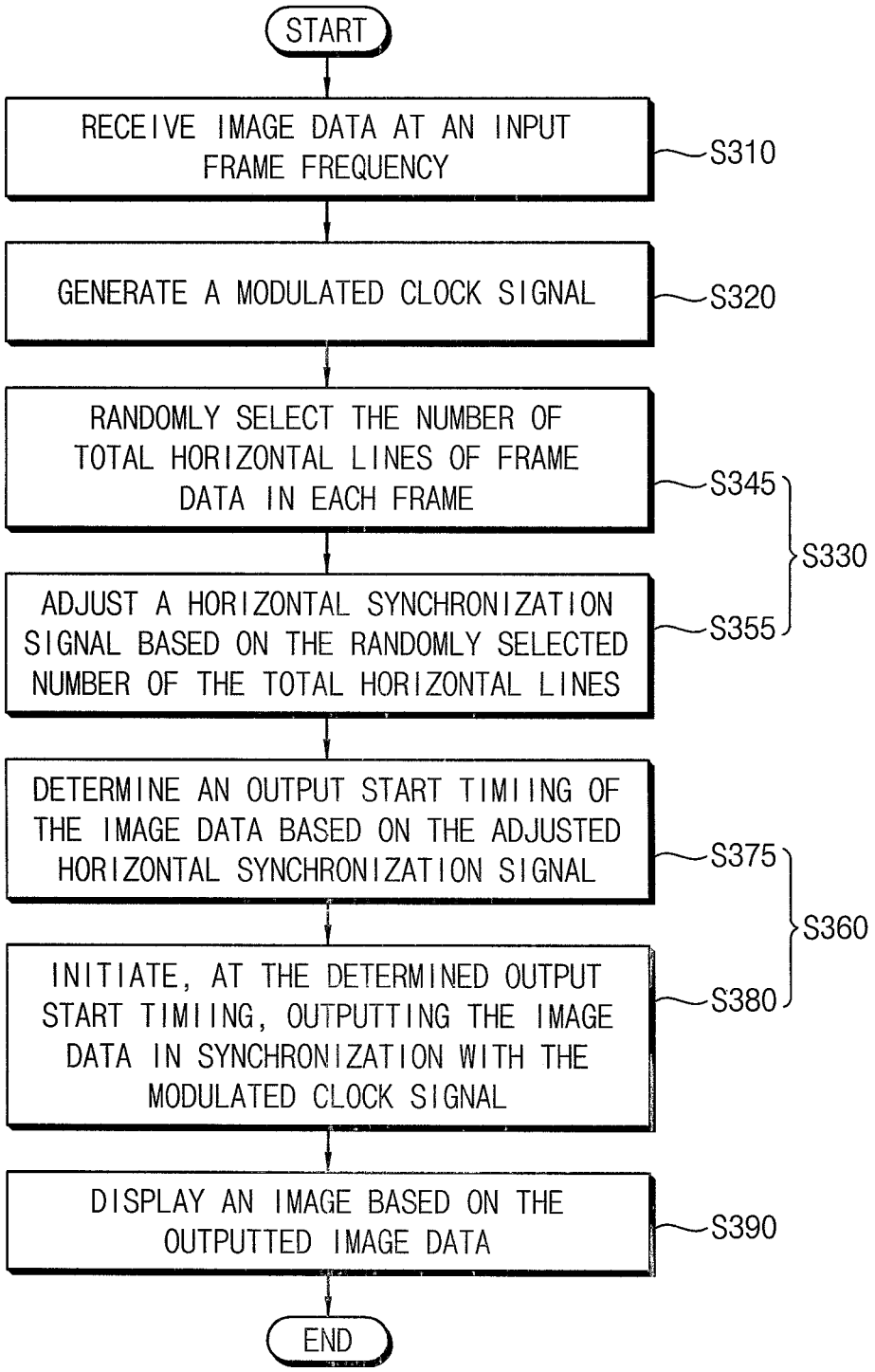
FIG. 8 is a flowchart illustrating a method of operating a display device according to example embodiments.
Figure 9:
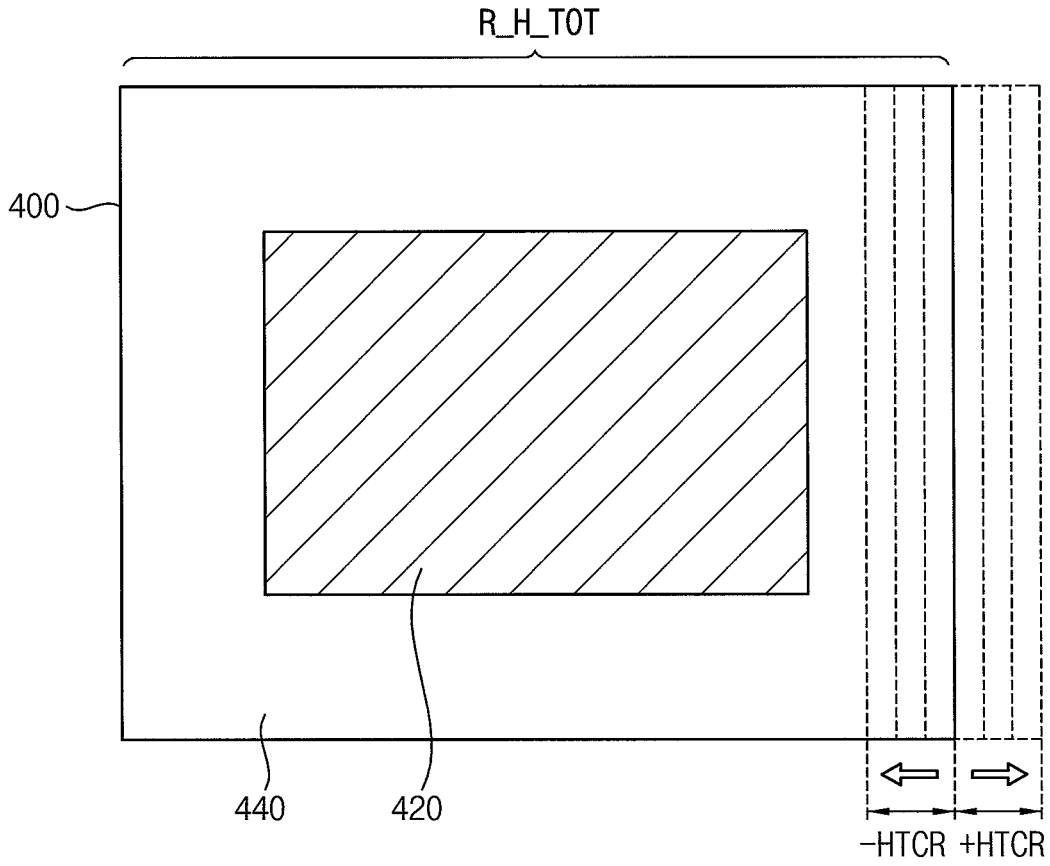
FIG. 9 is a diagram describing an example where the number of total horizontal lines of frame data is randomly changed.
Figure 10:
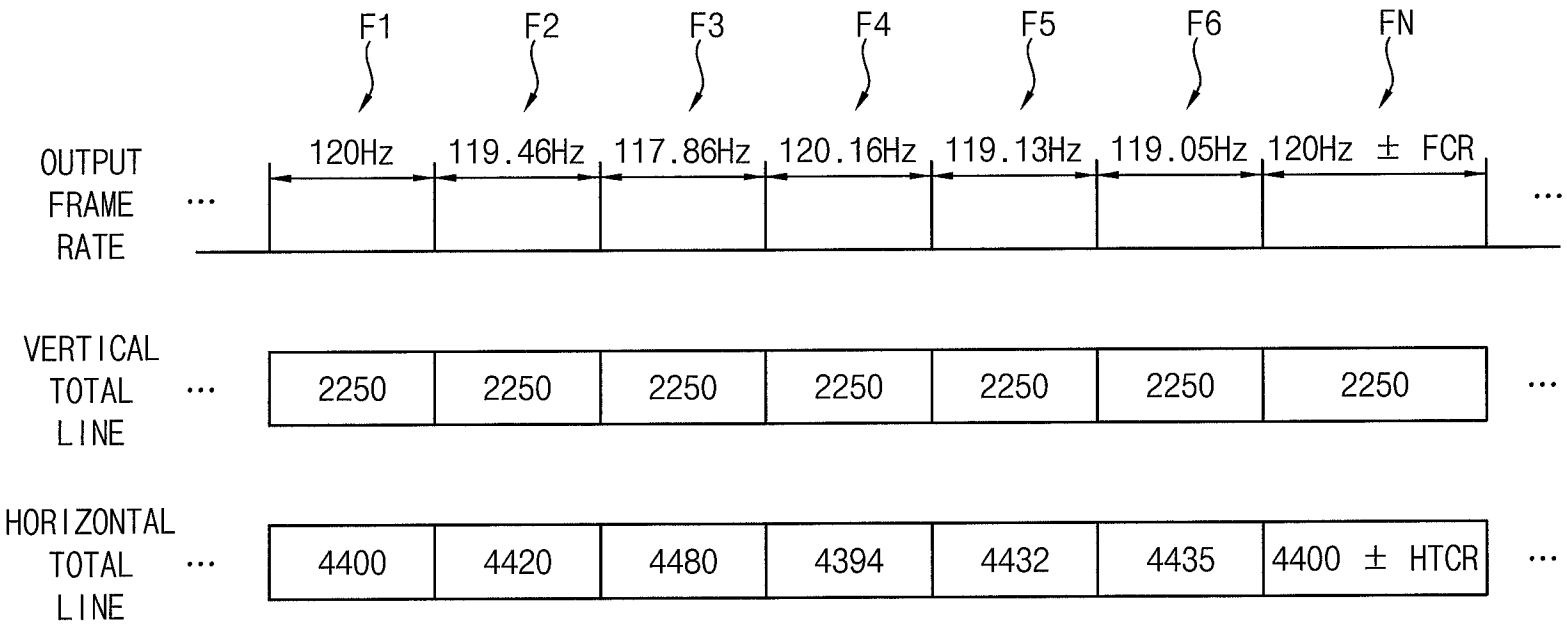
FIG. 10 is a diagram describing an example where an output frame frequency is changed in each frame depending on a change of the number of total horizontal lines.

FIG. 8 is a flowchart illustrating a method of operating a display device according to an example embodiment, FIG. 9 is a diagram describing an example in which the number of total horizontal lines of frame data is randomly changed, and FIG. 10 is a diagram describing an example in which an output frame frequency is changed in each frame depending on a change of the number of total horizontal lines.

Referring to FIGS. 7 and 8, the timing controller 140*b* may receive image data IDAT at an input frame frequency (e.g., a predetermined input frame frequency) (S310). The timing controller 140*b* may also receive an input clock signal ICLK, and a clock modulation block 170 of the timing controller 140*b* may generate a modulated clock signal MCLK by modulating the input clock signal ICLK according to a modulation frequency (e.g., a predetermined modulation frequency) (S320).

The frequency randomizer 150*b* of the timing controller 140*b* may randomly select an output frame frequency within a data frequency selection range, which includes the input frame frequency, in each frame (S330). In some example embodiments, to randomly select the output frame frequency, the total horizontal line randomizer 153 of the frequency randomizer 150*b* may randomly select the number of total horizontal lines of frame data in each frame (S345) and may generate an adjusted horizontal synchronization signal AHSYNC by adjusting a timing of a horizontal synchronization signal HSYNC to correspond to the randomly selected number of the total horizontal lines (S355).

For example, referring to FIG. 9, the image data IDAT including the input frame frequency received during one frame period, or frame data 400, may have a reference total horizontal line number R_H_TOT corresponding to the input frame frequency. The total horizontal line randomizer 153 of the frequency randomizer 150*b* may randomly select the number of horizontal lines to be added to or subtracted from the reference total horizontal line number R_H_TOT corresponding to the input frame frequency within a horizontal line change range HTCR and may determine the number of the total horizontal lines by adding or subtracting the randomly selected number of the horizontal lines to or from the reference total horizontal line number R_H_TOT. Accordingly, a length of a frame period for one frame may be randomly adjusted, and the output frame frequency may be randomly determined.

The timing controller 140*b* may output the image data ODAT including the randomly selected output frame frequency (S360). In some example embodiments, the synchronization circuit 155*b* of the timing controller 140*b* may determine an output start timing of the image data ODAT based on the adjusted horizontal signal AHSYNC that is adjusted corresponding to the randomly selected output frame frequency or the randomly selected number of the total horizontal lines (S375). The synchronization circuit 155*b* may initiate outputting of the image data ODAT at the output start timing and may output the image data ODAT in synchronization with the modulated clock signal MCLK (S380).

For example, as illustrated in FIG. 10, in a first frame F1, when the total horizontal line randomizer 153 selects 4400 as the number of the total horizontal lines, which is the same as the reference total horizontal line number R_H_TOT, the synchronization circuit 155*b* may output the image data ODAT having an output frame frequency of 120 Hz, which is the same as the input frame frequency. In second, third, fifth, and sixth frames F2, F3, F5, and F6, when the total horizontal line randomizer 153 selects 4420, 4480, 4432, and 4435 as the number of the total horizontal lines, respectively, each of which are greater than the reference total horizontal line number R_H_TOT, a length of a frame period of each of the second, third, fifth, and sixth frames F2, F3, F5, and F6 may be increased, and the synchronization circuit 155*b* may output the image data ODAT at an output frame frequency of about 119.46 Hz, about 117.86 Hz, about 119.13 Hz, and about 119.05 Hz, respectively, each of which are decreased from the input frame frequency. Further, in a fourth frame F4, when the total horizontal line randomizer 153 selects 4394 as the number of the total horizontal lines, which is less than the reference total horizontal line number R_H_TOT, a length of a frame period of the fourth frame F4 may be decreased, and the synchronization circuit 155*b* may output the image data ODAT at an output frame frequency of about 120.16 Hz, which is increased from the input frame frequency. Thus, in a frame FN, the total horizontal line randomizer 153 may select the number of the total horizontal lines in a range between the reference total horizontal line number R_H_TOT plus the horizontal line change range HTCR and the reference total horizontal line number R_H_TOT minus the horizontal line change range HTCR, and the synchronization circuit 155*b* may output the image data ODAT at an output frame frequency in a range between the input frame frequency plus a frame change range FCR and the input frame frequency minus the frame change range FCR.

A display device may display an image based on the image data ODAT outputted at the output frame frequency (S390). Accordingly, even when the modulation frequency of the modulated clock signal is fixed or constant in each frame, a length of each frame period in which an image is displayed may be varied according to the randomly selected output frame frequency or according to the randomly selected number of the total horizontal lines. Thus, a location of a horizontal line where the image is displayed with relatively high luminance and a location of a horizontal line where the image is displayed with relatively low luminance may be randomly changed in each frame, thereby preventing or mitigating a horizontal line defect and/or a waterfall defect.

Figure 11:
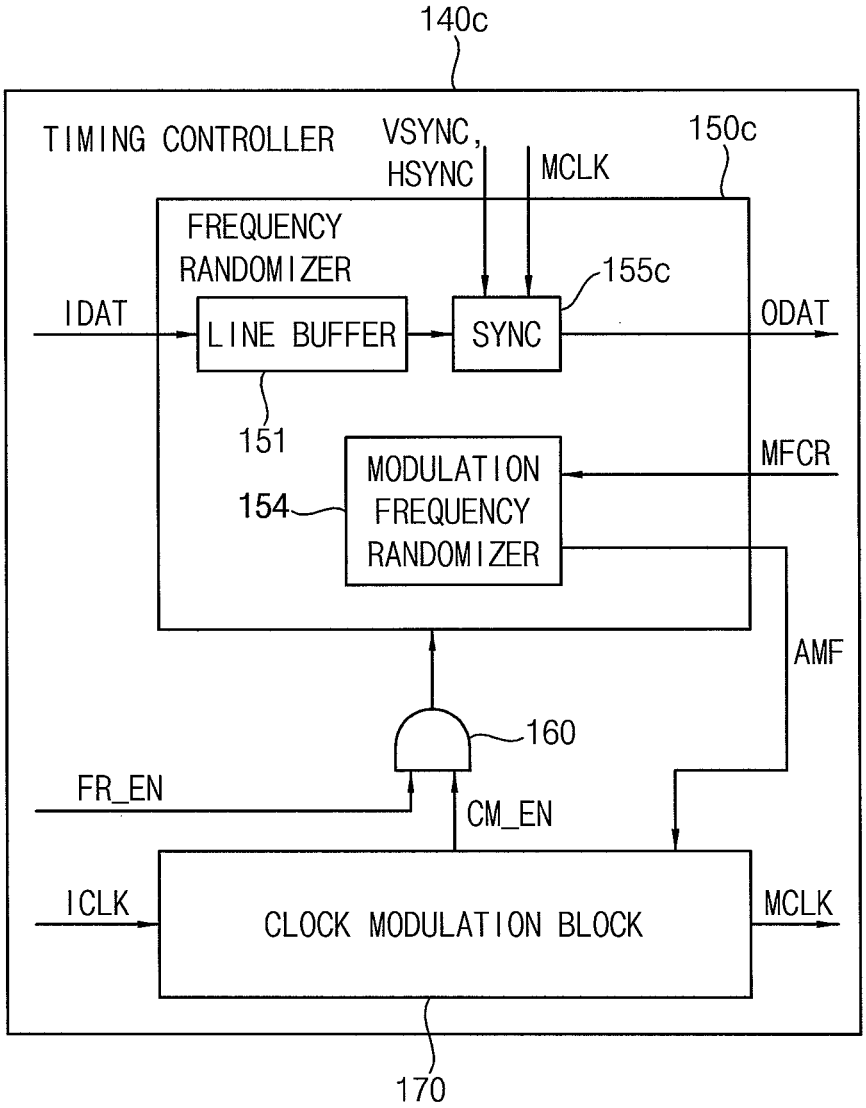
FIG. 11 is a block diagram illustrating a timing controller according to example embodiments.

FIG. 11 is a block diagram illustrating a timing controller according to an example embodiment.

The timing controller 140*c* shown in FIG. 11 may have a similar configuration and may operate similarly to the timing controller 140*a* shown in FIG. 3 and/or the timing controller 140*b* shown in FIG. 7, except that the timing controller 140*c* may include a modulation frequency randomizer 154.

Referring to FIG. 11, the timing controller 140*c* may include a frequency randomizer 150*c*, which randomly selects a modulation frequency of a modulated clock signal MCLK in each frame, a clock modulation block 170, and an AND gate 160. The frequency randomizer 150*c* may include a line buffer 151, the modulation frequency randomizer 154, and a synchronization circuit 155*c*. The synchronization circuit 155*c* initiates outputting image data ODAT in response to a vertical synchronization signal VSYNC and a horizontal synchronization signal HSYNC and outputs the image data ODAT in synchronization with the modulated clock signal MCLK that is modulated according to the randomly selected modulation frequency.

The modulation frequency randomizer 154 may receive a signal representing a modulation frequency change range MFCR and may randomly select a frequency to be added to or subtracted from a reference modulation frequency within the modulation frequency change range MFCR. The modulation frequency randomizer 154 may adjust the modulation frequency by adding or subtracting the randomly selected frequency to or from the reference modulation frequency and may provide the adjusted modulation frequency AMF to the clock modulation block 170. The clock modulation block 170 may generate the modulated clock signal MCLK having the adjusted modulation frequency AMF, and the synchronization circuit 155*c* may output the image data ODAT in synchronization with the modulated clock signal MCLK having the adjusted modulation frequency AMF.

Hereinafter, a method of operating a display device including the timing controller 140*c* according to example embodiments will be described below with reference to FIGS. 11-14.

Figure 12:
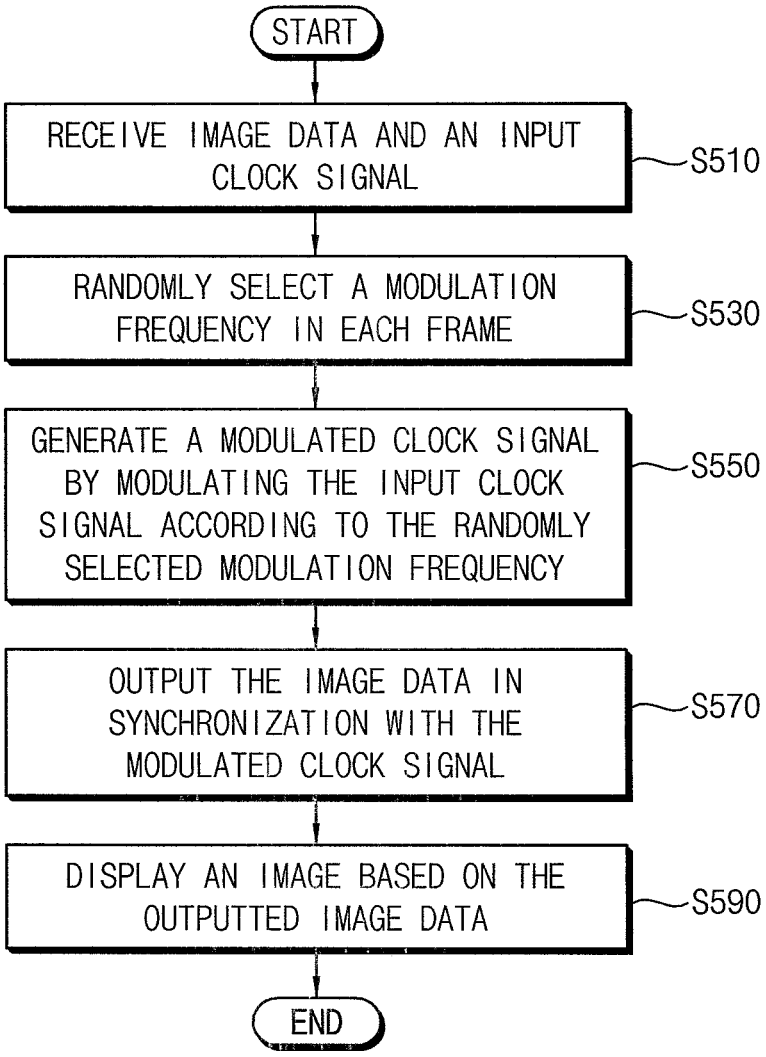
FIG. 12 is a flowchart illustrating a method of operating a display device according to example embodiments.
Figure 13:
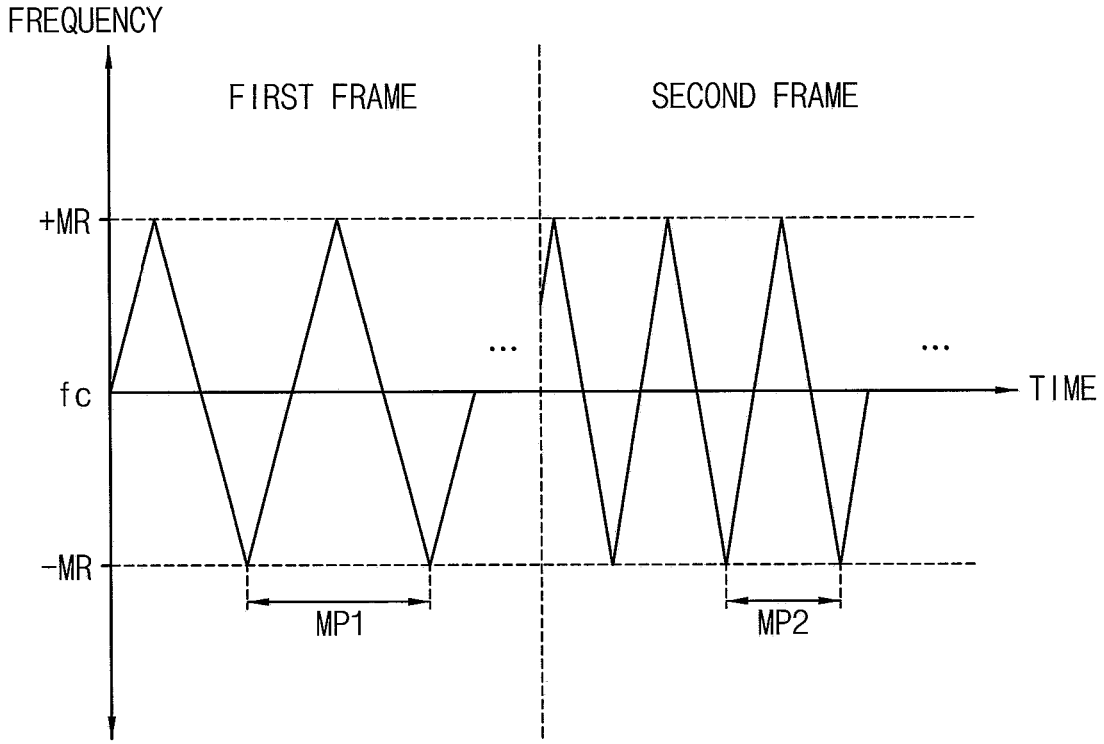
FIG. 13 is a diagram describing an example of a modulated clock signal in first and second frames.
Figure 14:
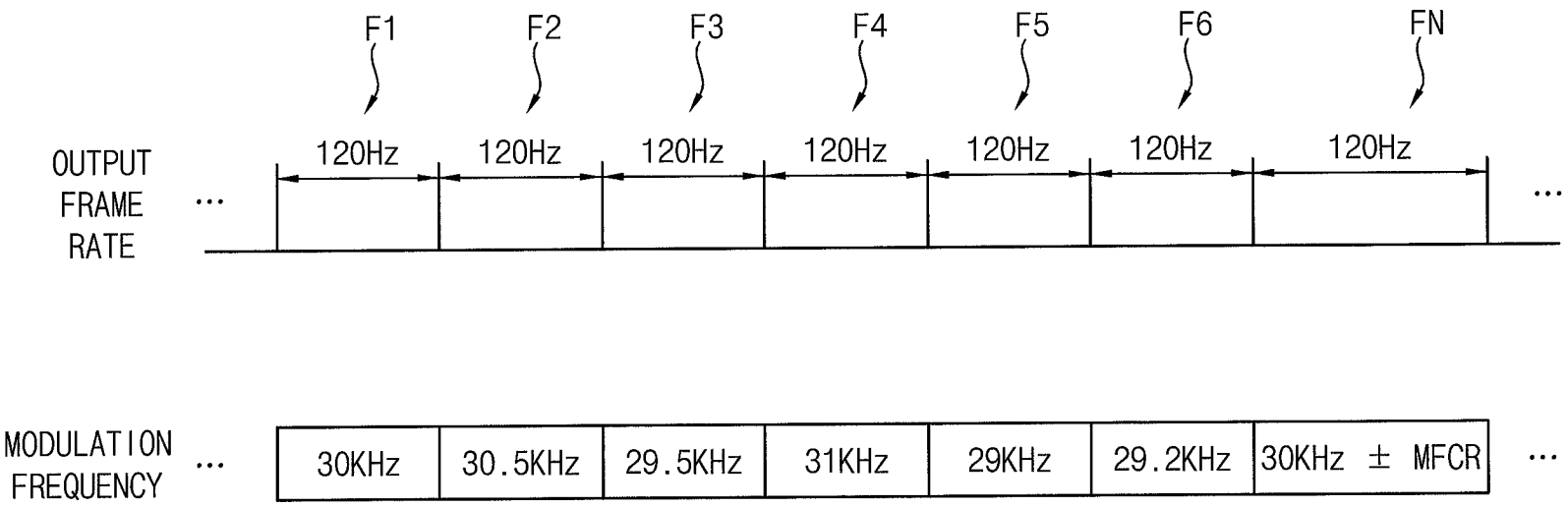
FIG. 14 is a diagram describing an example where a modulation frequency is changed in each frame.

FIG. 12 is a flowchart illustrating a method of operating a display device according to an example embodiment, FIG. 13 is a diagram describing a modulated clock signal in first and second frames according to an example, and FIG. 14 is a diagram describing an example in which a modulation frequency is changed in each frame.

Referring to FIGS. 11 and 12, the timing controller 140*c* may receive image data IDAT (at an input frame frequency (e.g., a predetermined input frame frequency)) and an input clock signal ICLK (S510).

A modulation frequency randomizer 154 may randomly select a modulation frequency in each frame (S530), and a clock modulation block 170 may generate a modulated clock signal MCLK by modulating the input clock signal ICLK according to the randomly selected modulation frequency (S550).

For example, as illustrated in FIG. 13, the clock modulation block 170 may generate the modulated clock signal MCLK by increasing or decreasing a frequency of the input clock signal ICLK by a modulation ratio (e.g., a predetermined modulation ration) MR from a center frequency fc. Further, the clock modulation block 170 may periodically modulate the input clock signal ICLK according to the randomly selected modulation frequency. In the example shown in FIG. 13, the input clock signal ICLK may be modulated according to a first modulation frequency in a first frame, and the input clock signal ICLK may be modulated according to a second modulation frequency that is higher than the first modulation frequency in a second frame. In this case, a modulation period MP2 of the modulated clock signal MCLK in the second frame may be shorter than a modulation period MP1 of the modulated clock signal MCLK in the first frame.

The synchronization circuit 155*c* may output the image data ODAT in synchronization with the modulated clock signal MCLK that is modulated according to the randomly selected modulation frequency (S570), and a display device may display an image based on the outputted image data ODAT (S590). For example, as illustrated in FIG. 14, even when an output frame frequency is fixed or constant at 120 Hz, the clock modulation block 170 may generate the modulated clock signal MCLK modulated according to the modulation frequency that is randomly selected in a range between a reference modulation frequency, for example, 30 KHz, plus a modulation frequency change range MFCR and the reference modulation frequency minus the modulation frequency change range MFCR. Accordingly, because the modulation frequency of the modulated clock signal MCLK is randomly changed in each frame, a location of a horizontal line where the image is displayed with relatively high luminance and a location of a horizontal line where the image is displayed with relatively low luminance may be randomly changed in each frame, thereby preventing or mitigating a horizontal line defect and/or a waterfall defect.

Figure 15:
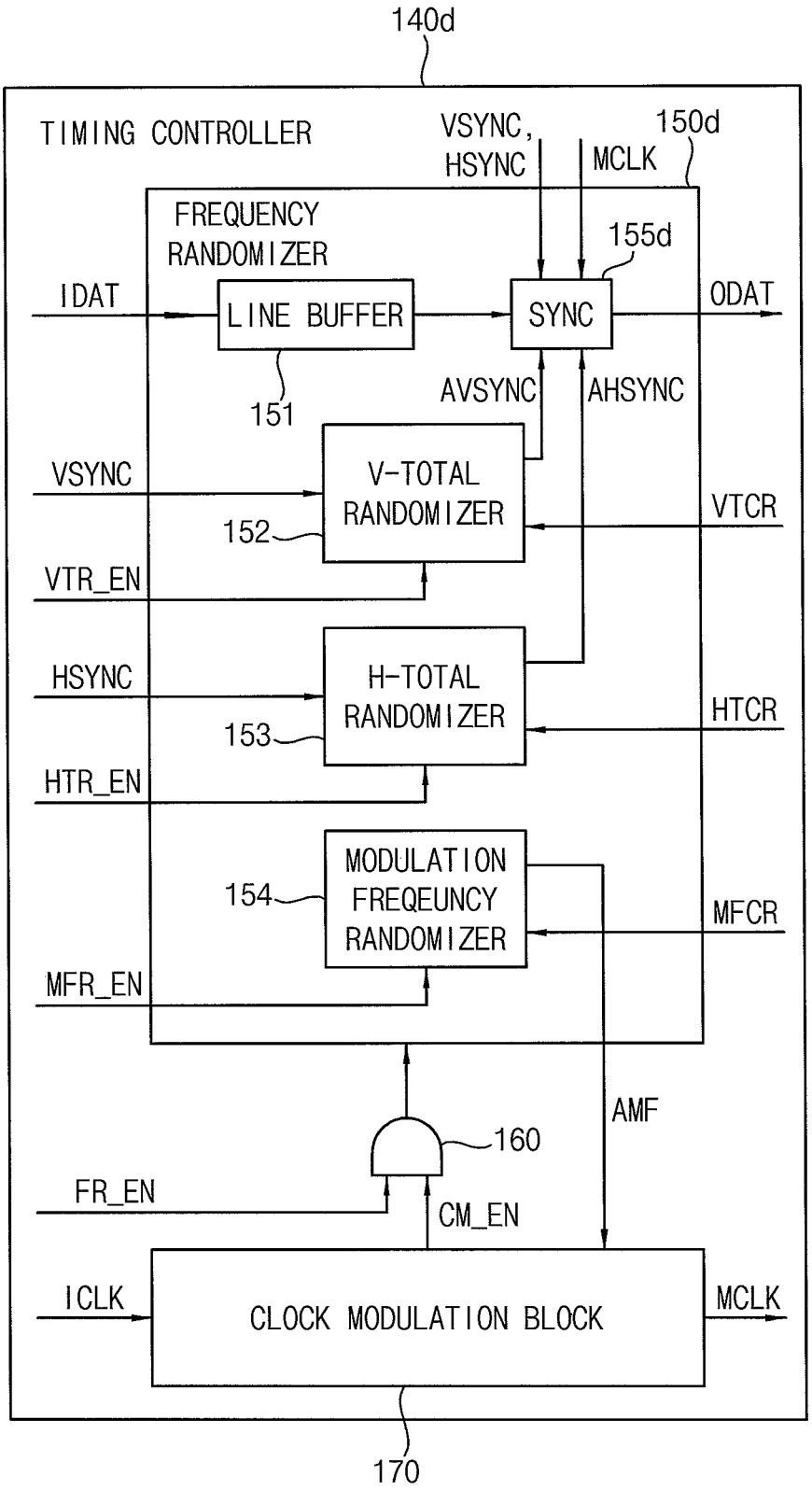
FIG. 15 is a block diagram illustrating a timing controller according to example embodiments.

FIG. 15 is a block diagram illustrating a timing controller according to an example embodiment.

The timing controller 140*d* shown in FIG. 15 may have a similar configuration and may operate similarly to the timing controller 140*a* shown in FIG. 3, the timing controller 140*b* shown in FIG. 7, and/or the timing controller 140*c* shown in FIG. 11, except that the timing controller 140*d* may include a total vertical line randomizer 152, a total horizontal line randomizer 153, and a modulation frequency randomizer 154.

Referring to FIG. 15, a frequency randomizer 150*d* of the timing controller 140*d* may include the total vertical line randomizer 152, which randomly selects the number of total vertical lines of frame data in each frame, the total horizontal line randomizer 153, which randomly selects the number of total horizontal lines of frame data in each frame, and the modulation frequency randomizer 154, which randomly selects a modulation frequency within a modulation frequency selection range, which includes a reference modulation frequency, in each frame. The total vertical line randomizer 152, the total horizontal line randomizer 153, and the modulation frequency randomizer 154 may be selectively enabled or activated in response to a total vertical line randomization enable signal VTR_EN, a total horizontal line randomization enable signal HTR_EN, and a modulation frequency randomization enable signal MFR_EN, respectively.

Embodiments of the present invention may be applied to any suitable display device using spread spectrum clock generation (SSCG) and any electronic device including the display device. For example, embodiments of the present invention may be applied to a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

The foregoing is illustrative of example embodiments and is not to be construed as limiting thereof. Although a few example embodiments have been described, those skilled in the art will readily appreciate that many modifications are possible in the example embodiments without materially departing from the aspects and features of the present invention. Accordingly, all such modifications are intended to be included within the scope of the present invention as defined in the claims and their equivalents. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims and their equivalents.

What is claimed is:

1. A display device comprising:

a display panel comprising a plurality of pixels;

a gate driver configured to provide gate signals to the plurality of pixels;

a data driver configured to provide data signals to the plurality of pixels; and a timing controller configured to receive image data at an input frame frequency and to control the gate driver and the data driver, the timing controller comprising:

a clock modulation block configured to generate a modulated clock signal by modulating an input clock signal according to a modulation frequency; and a frequency randomizer configured to randomly select an output frame frequency or the modulation frequency and to adjust an output timing of the image data based on the randomly selected output frame frequency or the modulated clock signal modulated according to the randomly selected modulation frequency, wherein the frequency randomizer is configured to randomly select the output frame frequency within a data frequency selection range, the input frame frequency being within the data frequency selection range, and to determine an output start timing of the image data based on the randomly selected output frame frequency, wherein the frequency randomizer comprises a total vertical line randomizer configured to randomly select a number of total vertical lines of frame data to randomly select the output frame frequency, and wherein the total vertical line randomizer is configured to receive a signal representing a vertical line change range, to randomly select a number of vertical lines to be added to or subtracted from a reference total vertical line number corresponding to the input frame frequency within the vertical line change range, to determine the number of the total vertical lines by adding or subtracting the randomly selected number of the vertical lines to or from the reference total vertical line number, and to adjust a vertical synchronization signal based on the randomly selected number of the total vertical lines.

2. The display device of claim 1, wherein the frequency randomizer further comprises a synchronization circuit configured to determine the output start timing of the image data based on the adjusted vertical synchronization signal.

3. The display device of claim 1, wherein the frequency randomizer further comprises a line buffer configured to temporarily store the image data in a unit of an active horizontal line.

4. The display device of claim 1, wherein the frequency randomizer further comprises a total horizontal line randomizer configured to randomly select a number of total horizontal lines of frame data to randomly select the output frame frequency.

5. The display device of claim 4, wherein the total horizontal line randomizer is configured to receive a signal representing a horizontal line change range, to randomly select a number of horizontal lines to be added to or subtracted from a reference total horizontal line number corresponding to the input frame frequency within the horizontal line change range, to determine the number of the total horizontal lines by adding or subtracting the randomly selected number of the horizontal lines to or from the reference total horizontal line number, and to adjust a horizontal synchronization signal based on the randomly selected number of the total horizontal lines.

6. The display device of claim 5, wherein the frequency randomizer further comprises a synchronization circuit configured to determine the output start timing of the image data based on the adjusted horizontal synchronization signal.

7. The display device of claim 1, wherein the frequency randomizer further comprises a modulation frequency randomizer configured to randomly select the modulation frequency within a modulation frequency selection range, a reference modulation frequency being within the modulation frequency selection range.

* * * * *